US005570830A

United States Patent [19]

Nichols

[11] Patent Number: 5,570,830

[45] Date of Patent: Nov. 5, 1996

[54] HOLSTER AND METHOD OF MANUFACTURE

[75] Inventor: Richard E. D. Nichols, San Diego, Calif.

[73] Assignee: R.E.D. Nichols & Associates, Inc., San Diego, Calif.

[21] Appl. No.: 443,091

[22] Filed: May 17, 1995

Related U.S. Application Data

[63] Continuation of Ser. No. 9,852, Jan. 27, 1993, abandoned.

[51] Int. Cl.[6] ..... F41C 33/02

[52] U.S. Cl. ..... 224/676; 224/193; 224/243; 224/677; 224/679; 224/911; 224/912

[58] Field of Search ..... 224/193, 243, 224/244, 253, 911, 912, 676, 677, 679

[56] References Cited

U.S. PATENT DOCUMENTS

| | | | |
|---|---|---|---|
| 2,546,774 | 3/1951 | Ohlemeyer . | |
| 2,893,615 | 7/1959 | Couper . | |
| 3,406,884 | 10/1968 | Perkins . | |
| 4,205,768 | 6/1980 | Hill et al. | 224/193 |
| 4,258,871 | 3/1981 | McMahon | 224/192 |
| 4,286,741 | 9/1981 | Rogers | 224/193 |
| 4,620,654 | 11/1986 | Cook | 224/243 |
| 4,846,383 | 7/1989 | Gallagher | 224/243 |
| 4,858,799 | 8/1989 | Young | 224/243 |
| 4,925,075 | 5/1990 | Rogers | 224/224 |
| 4,984,725 | 1/1991 | Urbom | 224/311 |
| 5,018,654 | 5/1991 | Rogers et al. | 224/244 |

*Primary Examiner*—Linda J. Sholl

*Attorney, Agent, or Firm*—Brown, Martin, Haller & McClain

[57] ABSTRACT

A holster has an elongate spine of rigid material with elongate grooves running along opposite sides of the spine, and a holster body with opposite side walls for forming a handgun receiving cavity. The rear edges of the side walls are each located in a respective one of the grooves in the spine so that the spine forms the rear end wall of the handgun receiving cavity. The holster body is secured to the spine via releasable or permanent fasteners.

17 Claims, 3 Drawing Sheets

HOLSTER AND METHOD OF MANUFACTURE

This is a continuation of application Ser. No. 08/009,852 , filed Jan. 27, 1993 now abandoned.

BACKGROUND OF THE INVENTION

The present invention relates generally to holsters for firearms and to a method of manufacturing such holsters, and is particularly concerned with a holster having a spine.

Holsters are typically constructed using several basic techniques. For example, some holsters are constructed using spaced, separate sidewall panels which are sewn or otherwise attached to one another along their front and rear edges to form a unitary handgun receiving cavity. In some cases, a single piece of material is folded to form the spaced side walls with a fold at the front or rear of the handgun receiving cavity, and the free edges of the side walls are sewn or otherwise fastened together at the opposite end of the cavity to form a welt or seam.

Some examples of holsters employing stitching at the front or rear seam, or both, are described in U.S. Pat. Nos. 2,546,774 of Ohlemeyer and 4,846,383 of Gallagher. Ohlemeyer discloses a holster with a front fold and a rear, stitched seam. A front sight receiving channel is incorporated into the front fold, either inside or outside of the holster cavity. U.S. Pat. No. 4,846,383 of Gallagher also describes a holster with a rear stitched seam and spaced side walls, with an elongate deformable spine at the front end of the cavity in which the forward ends of the side walls are engaged. The deformable spine is used to allow the front fold of the holster to conform more readily to the shape of the of the upper elongate surface of the handgun.

Stitching has some drawbacks when used to close the holster at the welt area. Where the holster is made of stiff, heavy leather, a heavy duty, harness-type stitching or sewing machine must be used, which is an expensive piece of machinery requiring a skilled operator. In addition to the actual stitching, associated tasks such as gluing and finishing the seams prior to and after stitching must be carried out, making holster manufacture a very labor intensive operation. Thus, holster manufacturers have sought to eliminate or at least reduce the labor-intensive operations typical of holster manufacture for many years, with little success. Even when the holster is made of softer fabric material, a similar construction is often used, with sewing machines or other types of fastener employed to close the holster seam or seams.

Another disadvantage in holsters in which seams are formed by stitching is that the welt stitching may fail in certain situations, particularly in key stress points of the holster. Thus, for example, during a struggle between a police officer and an assailant for the officer's handgun, stress is typically placed on the holster at the seams or welts. It is therefore important that the welt areas of the holster are strong enough to resist the resultant stresses. This has led to reinforcements being built into holsters at the key stress points, such as welts and double stitching or rivets to help prevent the ripping of the stitches at a very critical point in the holster. This increased structure and complexity has led to significant increases in the cost of holsters, which can now sometimes cost as much as some of the handguns to be carried in such holsters. Even with stitching and rivets, these holsters still fail on occasion.

In the event that a traditionally stitched holster needs to be disassembled for servicing, such as when a key component inside has failed or needs replacement or repair, it must be cut open prior to the repair and re-stitched after completion. Thus, servicing or repair of such holsters is typically very expensive. Additionally, holsters are easily damaged during such repairs, even when performed by an experienced holster maker, to the point where the repaired holster may be unacceptable to a discriminating user.

Additional structures are often incorporated in holsters, such as sight protection devices along the front of the handgun receiving cavity and handgun retention or gripping devices which are typically incorporated inside the cavity along the rear of the holster.

Although holsters made of soft fabric rather than leather and metal or hard plastic are typically of lower cost and easier to construct, the lower cost is achieved at the sacrifice of rigidity and associated performance and life of the product.

Increased rigidity of holsters, especially for use by uniformed police and other law enforcement officers, has been much sought-after to increase both the life and security of the holster, and to increase the performance of both the holster and the officer. However, some materials that provide such rigidity, such as hard plastic, are typically unsuited to stitching due to their brittle nature. Plastics and other such materials which will accept stitching can be prone to breakage at the stitch points during use. This has led to some manufacturers making such rigid holsters with a minimum of structural stitching, instead employing fasteners such as screws or rivets.

The present trend to incorporate more molded plastic parts into holsters, either in its components or as the holster body itself, has led to improved performance and product lifetime but at a substantial cost. The increased costs are due to the relatively high costs of molds and the resulting parts, when compared with other more conventional processes using traditional leather or other rigid materials such as plastic.

SUMMARY OF THE INVENTION

It is an object of the present invention to provide a new and improved holster assembly for a handgun or other firearm.

According to the present invention, a holster assembly is provided which comprises an elongate spine of rigid material having a pair of laterally spaced grooves running along at least part of the length of the spine, and a holster body having spaced side walls forming opposite sides of a handgun receiving cavity, each side wall having a rear edge secured in a respective one of the grooves so that the spine forms the rear end wall of the handgun receiving cavity.

The holster body may be formed from one piece of material folded along a central region to form substantially parallel side walls, or the side walls may be formed from separate pieces of material which may be connected together along their forward edges to form a front seam of the holster. The holster may be partially or fully open at the forward or front end of the cavity. In the latter case, the side walls will not be connected at their front edges.

The grooves are preferably parallel and oriented co-planar with the respective side walls of the cavity. The attachment of the spine to the side walls of the holster body may be releasable or permanent, for example using rivets, screw fasteners, ultrasonic, vibration or induction welding, staking, adhesives or hook and loop type fastener material, or may even be via stitching.

The holster assembly can be formed easily and inexpensively with little or no high skill operations being necessary. According to another aspect of the present invention, a method of forming a holster assembly is provided which comprises the steps of forming an elongate spine having a pair of laterally spaced grooves running along at least part of the length of the spine; forming a holster body having spaced side walls each of which has a free rear edge, locating the rear edge of each side wall in a respective one of the grooves, and securing the rear edges of the side walls to the spine to form a handgun receiving cavity having spaced side walls and a rear end wall.

This operation eliminates a number of the time consuming operations required in standard holsters, such as gluing and finishing welt seam layers, as well as labor and skill intensive stitching operations requiring skilled workers and expensive heavy duty sewing machines. This enables holsters to be made by lower skilled workers requiring less training time in view of the simple operations involved. This will considerably lower costs in holster manufacture. Assembly time will also be reduced since the parts can be assembled together quickly and easily.

With this method, various finishing operations can be done in advance of assembly. For example, finishing of the body can be done in advance while the panel is flat, saving cost. Production time can also be significantly reduced by the elimination of various time consuming operations such as forming, drying and stitching steps.

This structure and method also allows the holster body to be made in a wide variety of different materials, both soft and rigid. The holster body can now be made in stiff, impact-resistant materials since stitching, which was previously a limitation in forming holster bodies from hard, relatively brittle material, can be eliminated. The stiff spine also provides increased strength in a holster body formed from softer materials, making such materials more practical and reliable.

In practice, any suitable material may be used for the holster depending on the desired qualities of the holster, such as hard plastic, unreinforced fabrics, fabric and foam laminates, leather, soft plastics and rubber materials, and hybrid materials such as plastic or metal reinforced fabric materials.

Where the holster body and spine are releasably secured together via screw fasteners or the like, the ability to service and maintain the holster is improved. The spine can be separated readily from the holster body for servicing, repairing, or upgrading to improved materials or to insert improved accessories, even in the field.

Preferably, the holster body is formed from a single piece of material having a front fold and a pair of approximately parallel side walls. The holster body may be of any desired style, including open front or competition style or more secure closed front styles. The rigid spine forms the rear wall of the handgun receiving cavity.

The holster body may be preformed and shaped to fit a gun prior to attachment to the spine, if desired. Alternatively, the holster body may be simply attached to the spine without any preforming or molding before or after attachment.

The spine itself may be of any suitable cross-section incorporating a pair of spaced parallel grooves running along the length of the spine. Suitable cross-sectional shapes for the spine include circular, semi-circular, and rectangular. The spine may include a central channel and be of generally U-shaped cross-section to allow a gun-gripping device or other support for a handgun to be mounted in the central channel or groove.

Construction is simpler than in previous holster designs, since all stitching and forming of the holster body may be eliminated if desired. The holster can be assembled simply by bolting together several subassemblies, in the simplest form. Labor and machine costs can be considerably reduced, since less skilled operators are required and the assembly itself takes considerably less time due to the elimination of gluing, stitching and finishing operations at the welt area. Also, the need for expensive, heavy duty stitching machines is eliminated.

The holster may be suspended from a wearer's body in any standard manner, such as at the belt, shoulder, waist or ankle. It may be attached using a loop, paddle, harness, strap or other conventional means.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 1:
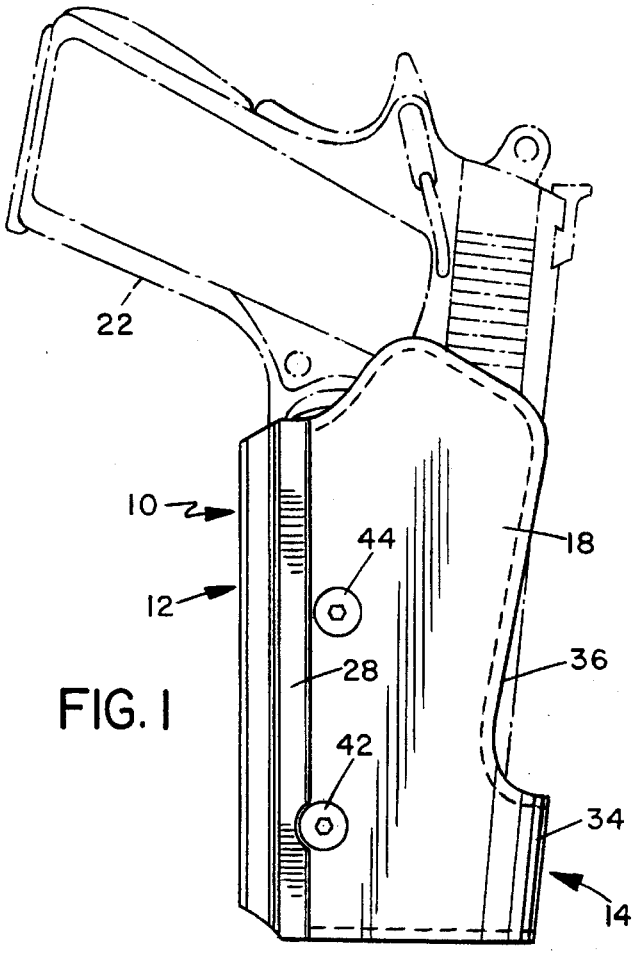
FIG. 1 is a side elevation view of one configuration of the holster, with a pistol indicated in broken line.

FIGS. 1–4 of the drawings illustrate a holster 10 according to a first embodiment of the present invention. The holster 10 basically comprises an elongate spine 12 of rigid material such as rigid plastic, metal, ceramics, composite material or the like, and a holster body 14 having side walls 16, 18 secured to the spine 10 to define a handgun receiving cavity 20 for receiving a handgun 22, as illustrated in dotted outline in FIGS. 1 and 3. The holster body may be of rigid or flexible material.

Figure 3:
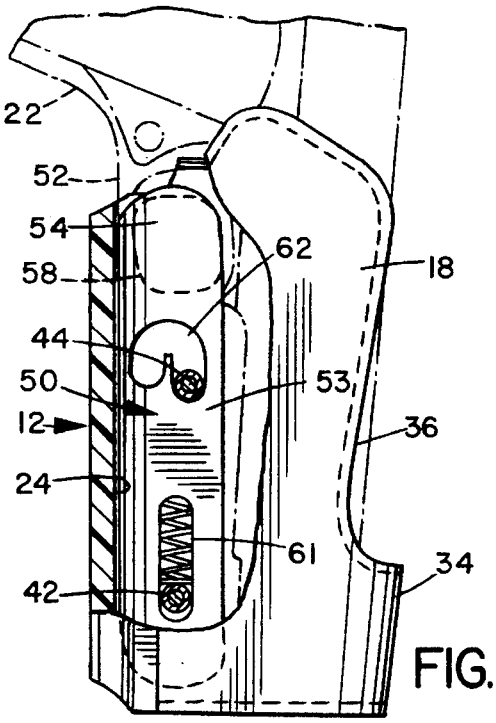
FIG. 3 is a side elevation view, with portions cut away to show the pistol retaining device which is adaptable to the holster.
Figure 4:
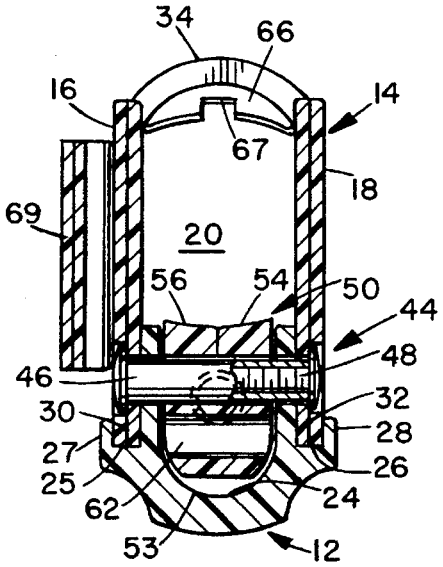
FIG. 4 is a top plan view of the holster.
Figure 5:
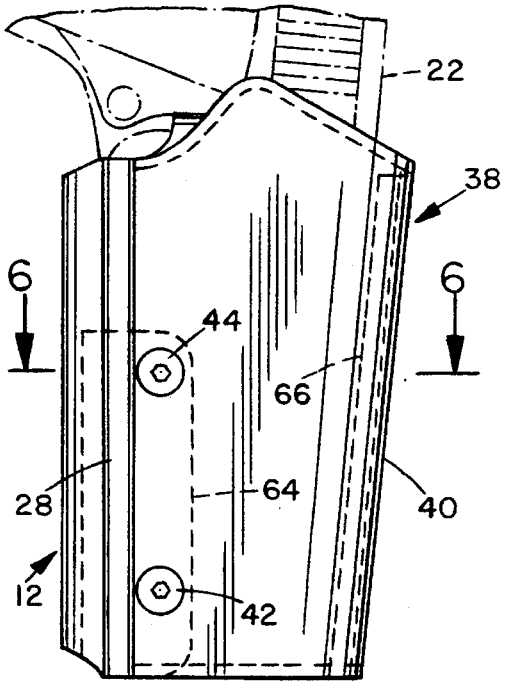
FIG. 5 is a side elevation view of an alternative, closed front holster.
Figure 6:
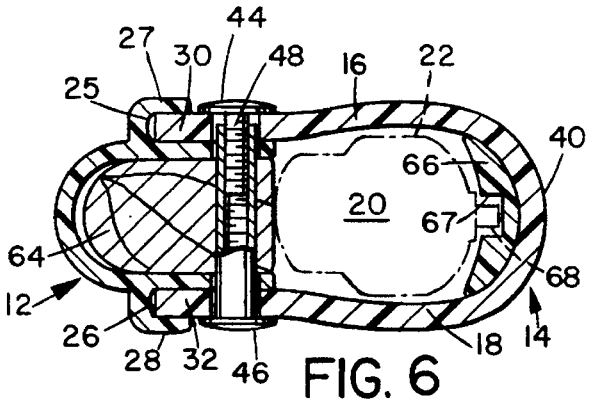
FIG. 6 is an enlarged sectional view taken on line 6—6 of FIG. 5.

As best illustrated in FIG. 4, the spine 10 is of basically U-shaped cross section, having a central groove or channel 24 facing inwardly into cavity 20, and a pair of side grooves 25, 26 formed by outwardly projecting, generally hook-shaped side flanges 27, 28 projecting from opposite sides of channel 24 for locating the rear edges 30, 32 of the respective holster body side walls 16, 18. In the version illustrated in FIG. 4, the holster body is folded at its forward end wall 34 from a single piece of material to form the spaced side walls 16 and 18, and the material is cut to form a partially open front 36 to the holster. However, other types and shapes of holster body may alternatively be used, and FIG. 5 illustrates an alternative one-piece holster body 38 having a closed front 40. Some parts of the alternative holster illustrated in FIGS. 5 and 6 are equivalent to those of FIGS. 1–4, and like reference numerals have been used where appropriate.

The holster body may be formed of any suitable material, including both the softer holster materials such as unreinforced fabrics, fabric and foam laminates, leather, soft plastics and the like, and the more rigid holster materials such as hard plastics, fabric materials reinforced with stiff plastics or metal, and the like. The body may be a single layer of material, or may be a laminate of two or more layers, as illustrated in FIG. 4. After folding the holster body along front fold 34, the rear edges of the side walls are inserted in the respective grooves 25 and 26 and the holster body is secured to the spine by suitable fasteners, such as the nut-and-bolt type fastener devices 42, 44 which extend through aligned openings in the holster body and underlying spine, as best illustrated in FIGS. 1 and 4. As illustrated in FIG. 4, each fastener 42, 44 includes a headed bolt or female fastener 46 having a threaded bore extending through one side of the holster body and a nut or male fastener 48 extending through the opposite side of the holster body for threaded engagement in the bore of fastener 46. The side flanges 27, 28 forming the grooves are of reduced height relative to the sides of the U-shaped central channel, and the fasteners 42 and 44 are positioned offset from the side flanges so as to project transversely through the holster body side walls and the central channel only of the spine, as best illustrated in FIGS. 1 and 4.

Preferably, the arrangement is such that the trigger guard 52 of the handgun is located at least partially inside the central channel in the holstered position illustrated in dotted outline in FIGS. 1 and 3, although it may be positioned outside the channel in alternative embodiments. Where the trigger guard is arranged to be at least partially inside the channel, a gripping device 50 for gripping the trigger guard 52 may be suitably mounted in the spine channel, such as the gripping device described in co-pending application Ser. No. 07/771,206 of Nichols, filed Oct. 4 1991 now U.S. Pat. No. 5,284,281 issue Feb. 8, 1994. The device 50 includes an elongate block 53 having a pair of opposed gripping fingers 54, 56 at its upper end with protrusions 58 for projecting into the trigger guard 52 when the handgun is retained in the holster. The side walls of channel 24 act as the pocket for retaining the protrusions 58 in the trigger guard, so no separate pocket member is necessary. Block 53 has a lower, linear slot 61 and an upper cam slot 62 through which the respective lower and upper fasteners 42, 44 extend with some free play, as illustrated in FIGS. 3 and 4. Cam slot 62 allows block 52 to pivot forwardly out of the channel 24 if the block is first depressed sufficiently to allow fastener 44 to reach the U-bend in the channel. This movement will release the protrusions from the channel side walls, allowing the trigger guard to be pulled out of the block, as described in more detail in co-pending application Ser. No. 07/771, 206, the contents of which are incorporated herein by reference.

Other types of trigger guard gripping devices or supports may alternatively be mounted in spine 12 if desired. If no gripping device is needed for the holster, channel 24 may be empty or may contain a suitable spacer block 64, as illustrated in FIG. 6, for added strength and rigidity. Fasteners 42 and 44 will extend through the spacer block 64 to retain it in the channel. The spacer or filler block is preferably of height less than the channel, as illustrated in FIG. 6, to allow space for accommodating the handgun trigger guard in the channel. The spacer or filler block will add rigidity to the assembly and will help to support the handgun.

Other devices may be incorporated in the holster as desired, for example a sight protector device or strip 66 as described in co-pending application Ser. No. 07/639,588 of Nichols, filed Jan. 9, 1991 now U.S Pat. No. 5,161,721 issued Nov. 10, 1992, the contents of which are incorporated herein by reference. The strip 66 may be suitably secured along front fold 34 of the partially open-front holster body 14 of FIGS. 1–4, or along front fold 40 of the closed-front holster body 38 of FIGS. 5 and 6. Strip 66 has a groove 67 along its length for locating a handgun front sight 68, as illustrated in dotted outline in FIG. 6.

Figure 2:
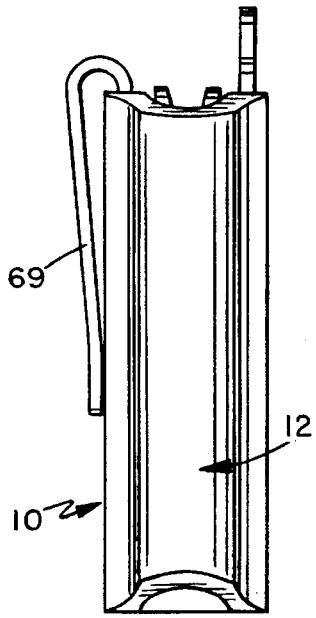
FIG. 2 is a rear elevation view of the holster.

One side wall 16 of the holster may have an integral belt loop or hanger 69 formed at its upper end, for suitably suspending the holster from a belt or the like, as illustrated in FIGS. 2 and 4. However, the holster may alternatively include other types of devices known in the art for suspending or attaching the holster relative to a wearer's body. The holster may be attached using a loop, paddle, harness, strap or the like, for example.

Figure 7:
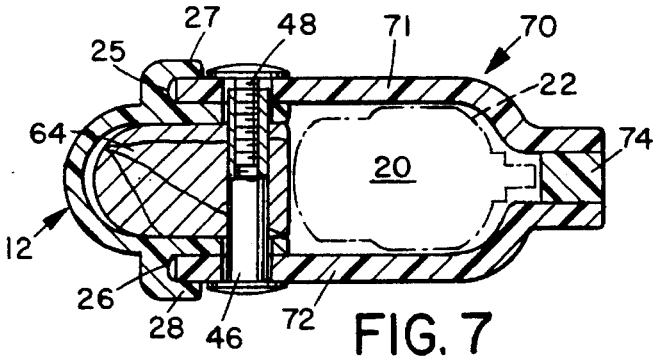
FIG. 7 is a similar sectional view showing an alternative two-piece holster body.

As noted above, the alternative embodiment illustrated in FIGS. 5 and 6 is similar to that of FIGS. 1–4 except that the holster body has a closed front and the trigger guard gripping device is replaced with a solid spacer member. FIG. 7 illustrates another modification in which the holster body 70 is formed in two pieces rather than one. In this alternative, spaced side walls 71, 72 are secured together at their forward ends by a spacer or welt 74 to which the side walls are secured by stitching, bolts or similar fasteners to form a partially or fully closed front. The holster in FIG. 7 is otherwise identical to that of FIGS. 1–4, 5 and 6, and like reference numerals have been used for equivalent parts.

Instead of the holster body having a partially open front or forward end, as in FIGS. 1–4, or a fully closed front end wall, as in FIG. 5, it may alternatively have a fully open front with the side walls being unsecured at their forward ends, with the holstered handgun being supported and secured at the rigid spine so that it cannot fall out of the holster. The latter alternative would be suitable for competition holsters and the like, where security against individuals attempting to remove a handgun from a holster is not essential.

The holster body may simply comprise a narrow strap for projecting from the spine around the handgun in another alternative, with a suitable support device for the handgun located in the spine, such as a muzzle plug.

Figure 8:
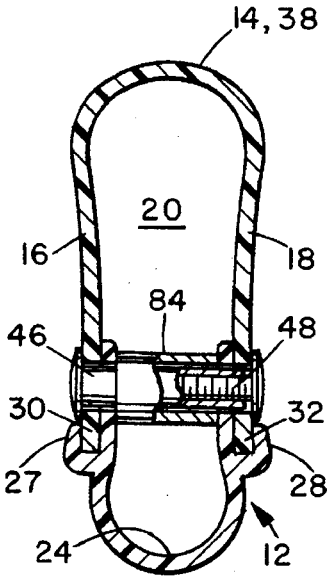
FIGS. 8–10 are sectional views similar to FIG. 6, showing alternative body-to-spine connections.
Figure 9:
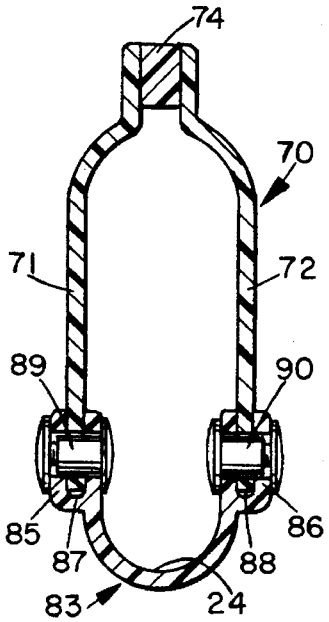

Although the holster body is secured to the spine via nut-and-bolt type fasteners 42 and 44 in the versions illustrated in FIGS. 1–7, it may alternatively be secured to the holster body by other types of releasable or permanent fasteners such as screws, rivets, adhesives, welding, staking or even by stitching, if desired. FIGS. 8 and 9 illustrated some of the other alternative means for securing a holster body to a spine. Some of the parts illustrated in FIGS. 8 and 9 are equivalent to those of some of the previously described embodiments, and like reference numerals have been used where appropriate.

In the alternative illustrated in FIG. 8, a partially or fully closed front holster body 14, 38 of the type illustrated in FIGS. 1–4 or FIGS. 5–7 has the rear edges 30, 32 of side walls 16, 18 secured in grooves 25, 26 formed by outwardly projecting flanges along opposite sides of the U-shaped spine 12 via one or more nut-and-bolt type or screw fasteners 42, 44 of the type described above in connection with FIGS. 1–7. However, in this alternative, the central channel 24 of the spine member is empty, and a suitable spacer or grommet 84 comprising a hollow cylindrical sleeve is slidably located over the shaft of female fastener 46 inside channel 24.

In the modification illustrated in FIG. 9, the holster body is equivalent to that illustrated in FIG. 6 although it may alternatively be a front fold holster body. However, in this embodiment, a modified, U-shaped spine member 83 has side flanges 85, 86 forming grooves 87, 88 having upper ends aligned with the upper end of the central channel 24. Instead of fasteners extending through the entire holster body as in the previous embodiments, in this embodiment each side wall 71, 72 is individually secured in the respective groove 87, 88 of the spine member via separate fasteners 89, 90, extending transversely through the respective groove and side wall. Fasteners 89, 90 may be similar to the fasteners 42, 44 or may alternatively be permanent fasteners such as rivets. In this alternative, the central channel 24 is empty.

Figure 10:
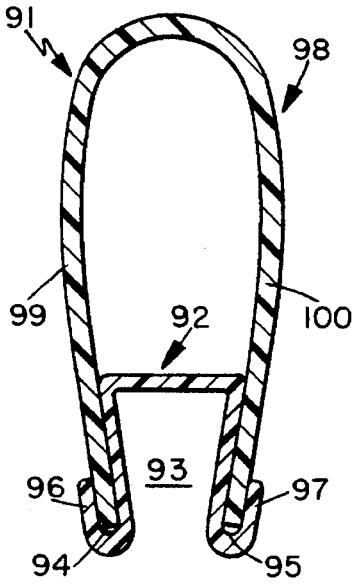

FIG. 10 illustrates a cross-section through a modified holster 91 comprising a rigid spine 92 having an outwardly facing, central channel 93 and a pair of side grooves 94, 95 formed by upturned rims 96, 97 on opposite sides of channel 93 and facing in the opposite direction to channel 93. A holster body 98, which may be of the same shape as the holster body 14 of FIGS. 1–4 or holster body 38 of FIGS. 5 and 6, has spaced side walls 99, 100 with rear edges secured in the respective side grooves 94, 95 by any suitable fasteners, such as those described above in connection with the previous embodiments, or by adhesives, welding or the like.

Although the spine comprises a generally U-shaped inwardly or outwardly facing channel member in the previously described embodiments, the spine may alternatively have other cross-sectional shapes. Additionally, instead of the grooves being formed by outwardly projecting flanges or rims on opposite sides of the central body or channel of the spine, they may be formed by simple indents or recesses in the main body of the spine. Some possible alternative spine shapes and groove formations are illustrated in FIGS. 11–14. Each of these may be used in combination with any selected holster body, including single fold holster bodies with closed or partially open fronts or two or more-piece holster bodies with closed or open fronts.

Figure 11:
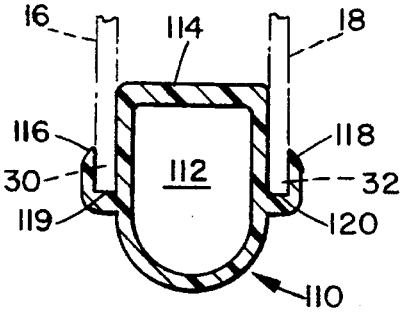
FIGS. 11–14 are sectional views of alternative spine configurations.

In the alternative illustrated in FIG. 11, the spine 110 has a closed central channel or bore 112 which is generally U-shaped as in FIGS. 1–9 but has a closed upper wall 114. Side flanges 116, 118 forming grooves 119, 120 are provided on opposite sides of the spine for receiving the rear edges 30, 32 of the side walls of a holster body in the manner described above in connection with FIGS. 1–9

Figure 12:
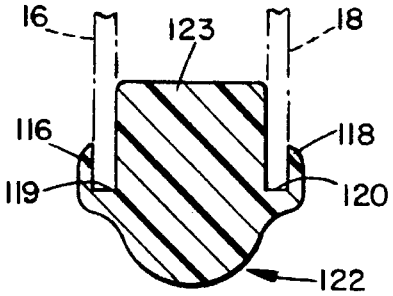

FIG. 12 illustrates a modified spine 122 which has a solid central body portion 123 rather than a hollow center as in the previous embodiments, but which is otherwise of similar shape to that of FIG. 11 and includes side grooves 119, 120 as in the embodiment of FIG. 11.

Figure 13:
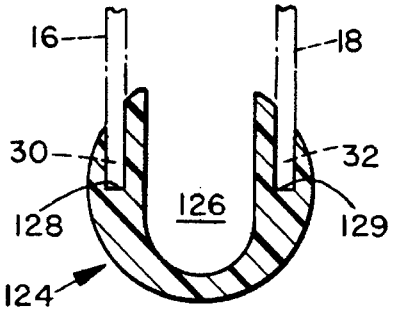

FIG. 13 illustrates another modified spine 124 which is of circular cross-section and has a central groove or channel 126 and side grooves 128, 129 formed in the circular body of the spine on opposite sides of channel 126 for receiving the rear edges 30, 32 of the holster body side walls. Channel 126 may alternatively be closed via a top wall as in FIG. 11, or the channel 126 may be eliminated and the spine may be of solid circular cross-section, in a similar manner to the different shaped solid spine of FIG. 12.

Figure 14:
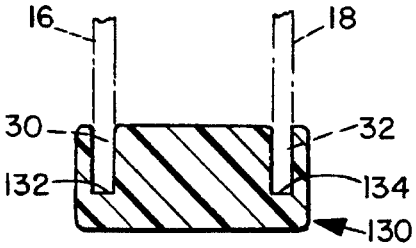

In the alternative embodiment of FIG. 14, the spine 130 is of solid rectangular cross-section and has grooves 132, 134 running along opposite sides of the spine for receiving the rear edges 30, 32 of the holster body side walls. Spine 130 may have a central channel in addition to side grooves 132, 134 if desired.

Other possible alternative cross-sectional shapes for the spine include semi-circular, rectangular, and other more complex shapes dependent on the specific application.

In each of the embodiments of FIGS. 11–14, the holster body may be secured to the spine by any suitable fasteners, such as the fasteners described above in connection with FIGS. 1–9 or any alternative fasteners.

The holster assembly may be left unformed after suitably securing the side walls in the spine member in many applications. However, if desired or necessary, depending on the application, the holster body may be formed to fit the handgun precisely either before or after securing the holster body to the spine, as is the current practice for leather and plastic holsters. Thus, the holster body is first softened before inserting the handgun and applying pressure over the holster body and inserted handgun. The holster body is then allowed to harden into its molded shape over the handgun.

Where the holster body is left unformed, the manufacturing procedure is considerably shortened and simplified. The elimination of costly precision forming is made possible by the combination of the rigid spine with flexible holster body material, such as nylon plastic. The plastic may be left uncovered, or covered with real or simulated leather, fabric, or other desired covering material on one or both sides. The spine holds the flexible holster body panel in tension, leaving an opening for accommodating the handgun, and with careful attention to the shaping of the spine and the material used for the holster body, the handgun can be accommodated and supported quite precisely without any need for form-fitting the holster body to the contours of the handgun.

The spine also allows more rigid materials to be used for the holster body if more durability and strength is desired in the holster, since no stitching is required. Thus a rigid, impact resistant holster body can be made much more easily than was previously possible, and at considerably reduced costs.

Where releasable fasteners such as screws or nut-and-bolt-type devices are used as the only means securing the spine to the holster body, the body or spine can be readily accessed for service, repair or replacement. Additionally, the holster can be readily upgraded to incorporate improved materials or install additional devices in the holster body or spine. The ability to completely or partially eliminate expensive and time consuming stitching operations and replace them with a bolt-together assembly method considerably reduces construction complexity and expense. Finishing of the body panel can be done in advance of assembly in the case where leather is used in the holster, while the panel is still flat, thus saving additional costs.

The fastener devices are located at key stress points in the holster, eliminating stitching at these areas and increasing the overall strength and durability of the holster. The holster body itself can be made much smaller since the rigid spine can support the handgun body completely or partially. This further reduces materials costs, and allows smaller and less expensive cutting dies to be used for cutting out the body panel.

Relatively economical extrusion tooling may be used for manufacturing the spine in extensive lengths which can then be cut to the desired holster dimensions. This will be considerably less expensive than the use of injection molding to produce plastic parts for holsters, as has been conventional in manufacture of such parts.

In this invention, weak and in some cases impractical stitching for securing holster parts together can be reduced or even completely eliminated. The simplified holster construction results in significantly reduced holster manufacturing and servicing costs. Costly forming and hand-finishing operations may be either considerably reduced or in some cases completely eliminated. The holster itself will be stronger and more durable, and the construction allows a large range of different flexible and rigid materials to be selectively used for the holster body.

Although some preferred embodiments of the invention have been described above by way of example only, it will be understood by those skilled in the field that modifications may be made to the disclosed embodiments without departing from the scope of the invention, which is defined by the appended claims.

I claim:

1. A holster assembly for a handgun, comprising:

an elongate spine of substantially rigid material having a pair of laterally spaced grooves running along at least part of the length of the spine;

a holster body secured to the spine to form a handgun receiving cavity having spaced side walls and an upper opening for receiving a handgun into the cavity;

each side wall having a rear edge secured in a respective one of the grooves in the spine and the spine forming an end wall of the cavity;

the spine having a central channel and the grooves being located on opposite sides of the channel, the channel facing inwardly into the handgun receiving cavity; and a spacer member secured to the spine and extending between opposite side walls of the channel, whereby the channel walls are non-deformable.

2. The assembly as claimed in claim 1, wherein the holster body comprises a single piece of material folded in a central region to form a pair of approximately parallel side walls.

3. The assembly as claimed in claim 1, including securing means for securing the side walls of the holster body to the spine, the securing means comprising at least one fastener device extending transversely at least partially through the spine and at least one side wall.

4. The assembly as claimed in claim 3, wherein said securing means comprises an upper and a lower fastener device each extending transversely through both side walls and the spine.

5. The assembly as claimed in claim 3, wherein each fastener device comprises a female fastener member having a threaded bore and a male fastener member for releasable threaded engagement in said threaded bore.

6. The assembly as claimed in claim 1, wherein said spine has a central portion having an inner end facing inwardly into said cavity, an outer end facing outwardly from said cavity, and opposite sides, and a pair of outwardly projecting, generally hook-shaped side flanges running along the opposite sides of said central portion to define said grooves.

7. The assembly as claimed in claim 1, wherein the spine has a central, elongate body portion having an inner face, an outer face, and opposite sides, said inner face having elongate recesses running along the length of said body portion adjacent opposite sides of said body portion, said recesses comprising said grooves.

8. A holster assembly for a handgun, comprising:

an elongate spine of substantially rigid material having a pair of laterally spaced grooves running along at least part of the length of the spine;

a holster body secured to the spine to form a handgun receiving cavity having spaced side walls and an upper opening for receiving a handgun into the cavity;

each side wall having a rear edge secured in a respective one of the grooves in the spine and the spine forming a rear end wall of the cavity;

securing means for securing the side walls of the holster body to the spine, the securing means comprising at least one fastener device extending transversely at least partially through the spine and at least one side wall;

the spine comprising a central body portion having central channel facing inwardly into the handgun receiving cavity and the respective grooves being located in the central body portion on opposite sides of the channel; and each fastener device extending transversely through both side walls of the holster and the central body portion of the spine.

9. The assembly as claimed in claim 8, wherein the spine is of at least partially circular cross-section.

10. The assembly as claimed in claim 8, wherein said holster body is of substantially flexible material.

11. The assembly as claimed in claim 8, wherein said holster body is of substantially rigid material.

12. The assembly as claimed in claim 8, wherein said holster body has an at least partially open forward end wall.

13. A holster assembly for a handgun, comprising:

an elongate spine of substantially rigid material having a pair of laterally spaced grooves running along at least part of the length of the spine;

a holster body secured to the spine to form a handgun receiving cavity having spaced side walls and an upper opening for receiving a handgun into the cavity;

each side wall having a rear edge secured in a respective one of the grooves in the spine and the spine forming a rear end wall of the cavity;

said spine having a central portion having an inner end facing inwardly into said cavity, an outer end facing outwardly from said cavity, and opposite sides, and a pair of outwardly directed, generally hook-shaped side flanges running along the opposite sides of said central portion to define said grooves; and said flanges having ends offset from the inner end of said central portion, the assembly further including fastener means extending transversely through the side walls of said holster body and the central portion of said spine at a location offset from said side flanges.

14. The assembly as claimed in claim 13, wherein the spine has a central channel and the grooves are located on opposite sides of the channel.

15. The assembly as claimed in claim 14, wherein the channel faces inwardly into the handgun receiving cavity.

16. The assembly as claimed in claim 15, including a gripping device secured to the spine inside said channel for releasably engaging a part of a handgun inserted in the cavity to resist inadvertent removal of the handgun from the cavity.

17. The assembly as claimed in claim 13, wherein the spine forms a rear end wall of the cavity.

* * * * *